US005740981A

United States Patent [19]

Haak

[11] Patent Number: 5,740,981

[45] Date of Patent: Apr. 21, 1998

[54] METHOD OF WINDING A YARN TO A CROSS-WOUND PACKAGE

[75] Inventor: Dieter Haak, Remscheid, Germany

[73] Assignee: Barmag AG, Remscheid, Germany

[21] Appl. No.: 416,693

[22] PCT Filed: Aug. 4, 1994

[86] PCT No.: PCT/DE94/00906

§ 371 Date: Apr. 10, 1995

§ 102(e) Date: Apr. 10, 1995

[87] PCT Pub. No.: WO95/25510

PCT Pub. Date: Sep. 28, 1995

[30] Foreign Application Priority Data

Aug. 14, 1993 [DE] Germany ..... 43 27 394.7

[51] Int. Cl.[6] ..... B65H 63/00; B65H 54/28

[52] U.S. Cl. ..... 242/413.5; 242/36; 242/43.1

[58] Field of Search ..... 242/18 R, 18.1, 242/36, 413.1, 413.5, 413.9, 43.1, 43 R

[56] References Cited

U.S. PATENT DOCUMENTS

| | | | |
|---|---|---|---|
| 3,931,938 | 1/1976 | Hasegawa et al. | 242/413.5 X |
| 4,245,794 | 1/1981 | Hasegawa et al. . | |
| 4,394,986 | 7/1983 | Hasegawa et al. . | |
| 4,458,849 | 7/1984 | Miyake et al. | 242/36 |
| 4,494,702 | 1/1985 | Miyake et al. | 242/18 R |
| 4,504,024 | 3/1985 | Gerhartz . | |
| 4,697,753 | 10/1987 | Schippers et al. . | |
| 4,779,813 | 10/1988 | Sugioka et al. | 242/18.1 |
| 4,830,296 | 5/1989 | Ueda et al. | 242/413.5 X |
| 5,141,169 | 8/1992 | Sugioka | 242/18 R |
| 5,348,238 | 9/1994 | Yamauchi et al. | 242/43 R X |

FOREIGN PATENT DOCUMENTS

| | | |
|---|---|---|
| 0078979 | 5/1983 | European Pat. Off. . |
| 40 39 086 | 6/1992 | Germany . |

*Primary Examiner*—Michael Mansen

*Attorney, Agent, or Firm*—Bell Seltzer Intellectual Property Law Group of Alston & Bird llp

[57] ABSTRACT

A method of winding a yarn to form a cross wound package with a random wind, and wherein the yarn tension is controlled without influencing the crossing angles at which the yarn is deposited on the surface of the package. The tension is sensed upstream of the traversing triangle, and the resulting tension signal is superimposed on the basic control signals for controlling the yarn traverse and the rotational speed of the package, so as to maintain a desired tension and constant yarn crossing angles. An interference signal may also be superimposed upon the basic control signals to suppress the formation of undesired ribbons.

6 Claims, 1 Drawing Sheet

METHOD OF WINDING A YARN TO A CROSS-WOUND PACKAGE

BACKGROUND OF THE INVENTION

The invention relates to a method of winding a yarn to a cross-wound package in random wind.

Such a winding method is known, for example, from U.S. Pat. No. 4,245,794.

In the winding of yarn to cross-wound packages, in particular at high takeup speeds, the angle of deposit and the crossing ratio are important factors along with the progression of the yarn tension during the takeup, for the stability of the package, the avoidance of ribbon formation, as well as the satisfactory unwinding property of the package in further processing, and its transportation. It is therefore attempted in general to prevent, if possible, deviations in the yarn tension from empirically favorable settings, in particular also when suppressing a ribbon formation. On the other hand, it is known that the yarn tension increases during the winding process, as the package diameter becomes larger and, as a rule, mostly in an undesired manner, unless measures are taken, which counteract an increase in the yarn tension.

In a random wind, the yarn is traversed over the package surface during the winding cycle at a substantially constant traverse frequency, which leads, at a substantially constant advance of the yarn, to constant angles, at which the yarn is deposited on the package surface. A random wind is distinct from a precision wind, wherein spindle and the drive of the yarn traverse mechanism assume mechanically or electronically a ratio, which is preset constant, and not formed by whole numbers. Also, in the case of a precision wind, the angle of deposit decreases steadily, as the package diameter increases.

Measures of influencing the progression of the yarn tension during the takeup are known from the art, for example, from the above-mentioned U.S. Pat. No. 4,245,794.

The method described in this patent includes, between the yarn feed godet and the inlet end of the yarn traverse mechanism, a yarn tension converter and a rotating pulsation device, which is controlled as a function of the traverse speed. According to the winding process to be carried out on the apparatus, the pulsation device is to equalize the yarn tension fluctuations caused by the traverse mechanism substantially in that it causes the yarn to deflect, synchronously with its traversing motion, from its straight-line path to both sides. The yarn tension converter provided in the path of the yarn upstream of the pulsation device is intended to convert changes in the yarn tension, which are in particular caused by the increase in the package diameter, into control pulses for influencing the spindle speed, so that an increasing yarn tension is counteracted by a lowering of the spindle speed, and vice versa.

However, this results in that as a function of the yarn tension progression, also the angle of deposit and the crossing ratio are changed in an unforeseeable, undesired manner.

It is the object of the invention to control the yarn tension without influencing the crossing ratio and the angle of deposit.

SUMMARY OF THE INVENTION

The above and other objects and advantages of the present invention are achieved by a random winding method which includes advancing the yarn at a substantially constant speed to a stationary yarn guide, traversing the advancing yarn at a location between the stationary yarn guide and a rotating yarn bobbin so as to form a cross wound package on the rotating bobbin, and generating basic control signals for the traversing speed and the rotational speed of the package respectively such that the yarn is deposited on the package at crossing angles which are substantially constant during the build of the package. In addition, the tension of the advancing yarn is sensed at a location upstream of the stationary yarn guide and a tension signal is produced which is representative of the sensed tension. The tension signal is superimposed upon the basic control signals to produce final control signals for respectively controlling the traversing speed and the rotational speed of the package such that the traversing speed and the rotational speed of the package are adjusted to maintain a desired tension in the advancing yarn and while maintaining substantially constant crossing angles of the yarn on the package.

In the preferred embodiment, the step of superimposing the tension signal upon the basic control signals includes adjusting the traversing speed and the rotational speed of the package by the same tension dependent ratio. Also, a further signal may be superimposed upon at least one of the basic control signals for the purpose of suppressing the formation of undesired ribbons on the wound package.

It is known, from U.S. Pat. No. 4,394,986 to apply in a continuous winding process with several winding spindles, which are operated one after the other, an electric correction signal, which is obtained from measuring the yarn tension, to both the drive motor for the winding spindle and to the drive motor for the yarn traversing mechanism. However, it should be remarked that this occurs only in the change phase of the chucks and for the acceleration of the empty tube. During the entire winding cycle, this would be disadvantageous, since a simultaneous reduction of the rotational speed of the winding spindle and of the traverse frequency at the same ratio causes the angle of deposit to change continuously, as the package diameter increases, which is disadvantageous for the package build.

In comparison therewith, in the method of this invention the winding ratio or the K value, which is defined by the ratio of winding spindle speed to traverse frequency, as the number of double strokes, remains unchanged, when the yarn tension and, thus, the speed of the winding spindle are varied.

This avoids having the yarn tension and the control of the winding spindle speed intervene in the control of the traverse program. This is in particular of advantage in traverse programs, which are predetermined by the progression of the winding ratio, such as, for example, in EP 0 093 258 B and corresponding U.S. Pat. No. 4,504,024, or EP 0 195 325 B and corresponding U.S. Pat. No. 4,697,753. In the former publication (EP 0 093 258 B) the law of traverse is controlled as a function of the occurrence of certain critical winding ratios such that, when approaching one of these values, the traverse speed or the traverse frequency is switched to respectively the other of two values. In the second traverse program (EP 0 195 325 B), the traverse speed follows a rigidly predetermined program.

In the simplest case, such a traverse program includes a constantly predetermined traverse speed. Such a constantly predetermined traverse speed may also be superposed by fluctuations (wobbling). In the known method, the traverse speed does not remain constant, but is varied between an upper limit and a lower limit with a certain regularity, the upper limit and the lower limit changing likewise during the winding of a cross-wound package (winding cycle).

Experience has shown that both process variants do not serve to prevent every critical winding situation. Basically, critical winding situations are such, in which the traverse frequency and the spindle speed form an integral ratio or a ratio broken by an integer. These occurrences are described as "ribbon formation." The so-called "ribbon" represents not only a considerable interference with the package buildup, but may lead also to an interruption of the winding process and to the destruction of the takeup machine by occurring imbalances.

It has shown, however, that ribbon situations or ribbonlike situations may still occur at a winding ratio not formed by a whole number, or winding ratios, which are not broken by a small whole number (2, 3, 4 . . . ). These situations are in part process-dependent and unforeseeable.

The present invention permits such unforeseeable winding situations to be avoided.

Advantageously, for the progression of the yarn tension, a tolerance range is predetermined, which may be established, for example, by tests being aimed at this purpose, or by empirical values from the production. In particular, this tolerance range is intended to cover unavoidable, short-term fluctuations, which originate from the traversing motion.

The desired value of the yarn tension may also be determined in tests by averaging, and be preset as a long-term value.

The winding method of the present invention may be used with advantage both in a takeup machine, in which the packages are driven on their circumference by a driven roll at a constant rotational speed, and in a takeup machine, in which the winding spindle is driven by a shaft drive motor that is controlled by a sensing roll.

BRIEF DESCRIPTION OF THE DRAWINGS

The invention is described in more detail with reference to embodiments of an apparatus for carrying out the method of this invention, which are illustrated in the attached drawing.

In the drawing.

DETAILED DESCRIPTION OF THE PREFERRED EMBODIMENTS

Figure 1:
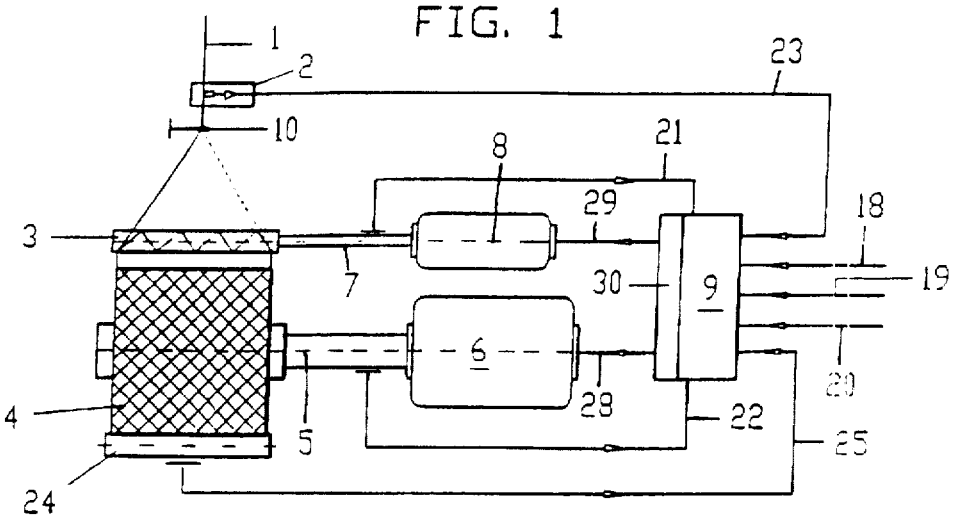
FIG. 1 is a schematic view of a winding position equipped in accordance with the invention and having a directly driven winding spindle.

FIG. 1 is a schematic view illustrating the setup of a winding position provided for carrying out the winding method in accordance with the invention, in which a yarn 1 is wound by a winding spindle 5 with a sensing roll 24 and direct drive 6 to a cross-wound package 4. Likewise a drive shaft 7 of a yarn traversing mechanism 3 is provided with a suitable drive 8. Both drives 6, 8 are controlled via a converter 30 and supply lines 28, 29 by a control unit 9. Instead of the direct drive by motor 6, it is also known as an alternative, and common practice to drive cross-wound package 4 on its circumference by a drive or friction roll, which is driven at a constant circumferential speed.

Figure 3:
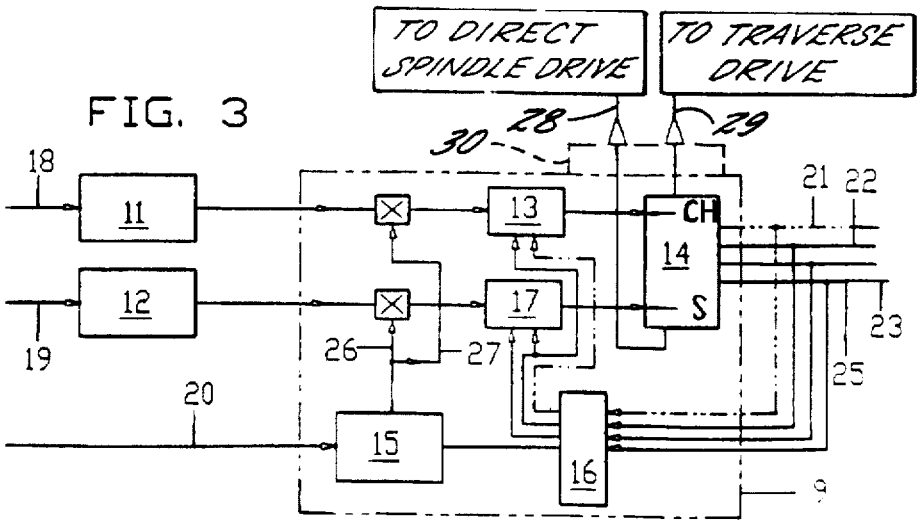
FIG. 3 is an operating diagram of a winding position with a direct drive of the winding spindle.

It is the task of control unit 9 to synchronize drives 6, 8 interdependently such that the crossing ratio and the angle of deposit are maintained consistent with the progression of desired values that are predetermined for the entire winding process. With respect to the embodiment wherein the winding spindle 5 is directly driven as illustrated in FIGS. 1 and 3, the desired and actual values (18 and 21) of the speed of the traverse mechanism 3, the desired and actual values (19 and 22) of the rotational speed of the winding spindle 5, and the desired and actual values (20 and 23) of the yarn tension are input into the control unit 9. In addition, the peripheral speed of the package 4 is sensed by a sensing roll 24, and a signal 25 representing the actual peripheral speed is fed to the control unit 9.

Between a feed system not shown in more detail and operating at a constant speed, for example, a godet that is looped by the yarn, and the inlet of an apex yarn guide 10 forming a traversing triangle, a yarn sensor 2 contacting yarn 1 is provided, which transmits, via a signalling line and a digital-analog converter, the progression of the measured yarn tension (signal 23) to control unit 9. The signals arriving from yarn tension sensor 2, are used in control unit 9 to modify the predetermined desired values of the control of drives 6, 8, so that along with the necessary change in the spindle speed for equalizing deviations of the yarn tension, likewise a change in the traverse speed occurs, so that the predetermined progression of crossing ratio and angle of deposit remains unchanged.

Figure 2:
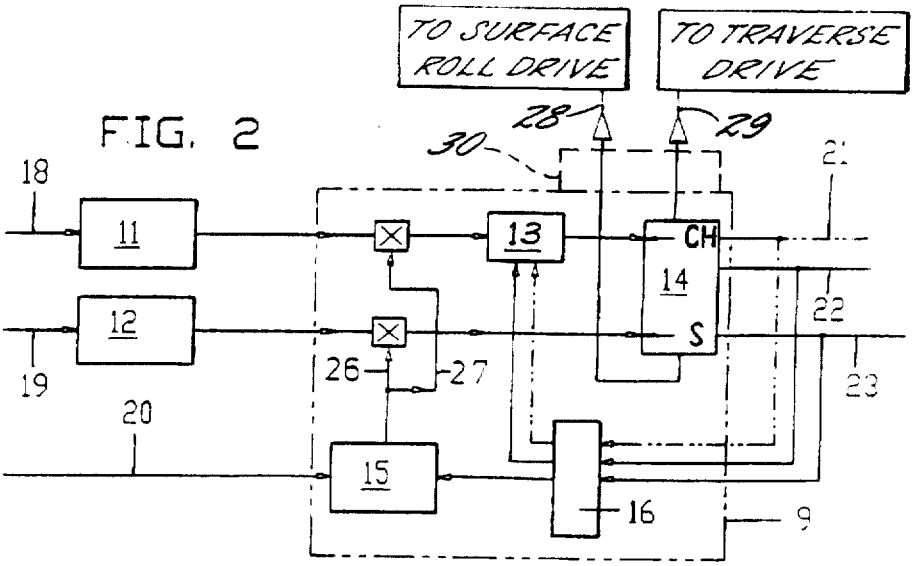
FIG. 2 is an operating diagram of a winding position wherein the winding spindle is driven by a surface friction roll.

The operating diagrams shown in FIGS. 2 and 3 are substantially identical as regards essential parts and, therefore, are provided with like numerals for comparable units.

Predetermined in both Figures are the basic frequencies, which are generated by basic frequency generators 11 (for traversing the yarn) and 12 (for driving the spindle), as well as the progression of desired values 20 of the yarn tension. In accordance with desired values 18, 19, which are predetermined by the winding program, generators 11, 12 produce the respective basic frequencies for the drive of the package and the drive of the yarn traversing mechanism, which are supplied to winding head control unit 14 associated with control unit 9. Provided in the supply line leading from generator 11, which produces the desired value 18 of the speed of the traverse mechanism, to winding head control unit 14 (connection CH) is an interference generator 13, which serves to generate the signals to be supplied to desired value 18 for the intended interference process (for example, wobbling), so as to suppress the ribbon formation. In FIG. 3 pertaining to a takeup device with a directly driven winding spindle (FIG. 1), a spindle drive control 17 is further provided in the line leading from basic frequency generator 12 to connection S of winding head control unit 14.

Winding head control 14 receives the constantly determined actual values, namely 21 of traversing mechanism 3 (double stroke rate, traverse frequency), 22 of the winding spindle speed, and 23 of the yarn tension, as well as the peripheral speed of the package (signal 25) that is determined by sensing roll 24 in the embodiment of FIG. 3. Besides that, the actual values enter in a unit 16 for acquiring actual values, which is associated with control unit 9, the actual value signal 23 of the yarn tension being transmitted to a control unit 15 for the yarn tension. The correction signals generated in control unit 15 arrive, via line 26, at connection S (winding spindle) of control unit 14 and, via line 27, at interference generator 13, whence they reach, together with the interference signals, connection CH of winding head control unit 14. In so doing, the signals generated by basic frequency generators 11, 12 are modified at both inputs of control unit 14 by a multiplicative evaluation with the same rating factor as a function of the yarn tension.

Moreover, the embodiment of FIG. 3 contains, in the line associated to the winding spindle drive and extending from basic frequency generator 12 to winding head control unit 14, a control unit 17 for the winding spindle drive. The signals arriving from unit 16 for acquiring actual values, and pertaining to the actual values 22 (winding spindle speed) and 25 (sensing roll), enter in this embodiment into control unit 17. Furthermore, actual value signal 22 of the winding spindle speed and, likewise, actual value signal 21 of the traversing mechanism arrive at interference generator 13.

In both embodiments, the outputs supplied to drives 6,8 via converter 30, are modified in winding head control unit 14, so that the progression of the actual values of the yarn tension is adapted to the progression of desired values, without interfering with the predetermined crossing ratio and angle of deposit.

It should further be pointed out that the method of controlling drives 6, 8 of a winding spindle 5 and its associated yarn traversing mechanism 3, as described with reference to FIGS. 1–3, may also be applied to a takeup machine having several winding spindles arranged on a package revolver, the winding spindles being likewise driven either by a direct drive as illustrated in FIGS. 1 and 3 or a friction roll drive as illustrated in FIG. 2.

I claim:

1. A method of winding an advancing yarn to form a cross wound package with a random wind, and comprising the steps of advancing the yarn at a substantially constant speed to a stationary yarn guide, traversing the advancing yarn at a location between the stationary yarn guide and a rotating yarn bobbin so as to form a cross wound package on the rotating bobbin, generating basic control signals for the traversing speed and the rotational speed of the package respectively such that the yarn is deposited on the package at crossing angles which are substantially constant during the build of the package, sensing the tension of the advancing yarn at a location upstream of the stationary yarn guide and producing a tension signal which is representative of the sensed tension, and superimposing the tension signal upon the basic control signals to produce final control signals for respectively controlling the traversing speed and the rotational speed of the package such that the traversing speed and the rotational speed of the package are adjusted to maintain a desired tension in the advancing yarn and while maintaining substantially constant crossing angles of the yarn on the package.

2. The method as defined in claim 1 comprising the further step of superimposing an interference signal upon at least one of the basic control signals and which acts to suppress the formation of undesired ribbons on the wound package.

3. The method as defined in claim 1 wherein the step of superimposing the tension signal upon the basic control signals includes adjusting the traversing speed and the rotational speed of the package by the same tension dependent ratio.

4. The method as defined in claim 3 wherein the rotating yarn bobbin is rotated by a drive roll which contacts the surface of the package being formed.

5. The method as defined in claim 3 wherein the rotating yarn bobbin is coaxially mounted upon a winding spindle, and wherein the winding spindle and yarn bobbin are rotated by a drive motor operatively connected to the spindle, and comprising the further step of sensing the peripheral speed of the package being formed and generating a signal which is representative of the sensed peripheral speed.

6. The method as defined in claim 1 comprising the further step of superimposing an interference signal upon at least one of the basic control signals and which acts to suppress the formation of undesired ribbons on the wound package, and wherein the step of superimposing the tension signal upon the basic control signals includes adjusting the traversing speed and the rotational speed of the package by the same tension dependent ratio.

* * * * *